US005458283A

United States Patent [19]

Southwell et al.

[11] Patent Number: 5,458,283

[45] Date of Patent: Oct. 17, 1995

[54] STACKABLE CONTAINER FOR STORING FRESH PRODUCE

[75] Inventors: James D. Southwell, Palatine; Victor R. Rioux, Buffalo Grove, both of Ill.; G. Robert Tidball, Wilton, Conn.; Charles C. Pierce, Duxbury, Mass.

[73] Assignee: Packaging Corporation of America, Evanston, Ill.

[21] Appl. No.: 428,527

[22] Filed: Apr. 24, 1995

[51] Int. Cl.[6] ..... B65D 5/42

[52] U.S. Cl. ..... 229/178; 229/191; 229/918; 229/919

[58] Field of Search ..... 229/178, 191, 229/915, 918, 919

[56] References Cited

U.S. PATENT DOCUMENTS

| | | | |
|---|---|---|---|
| 2,295,141 | 9/1942 | Van Wingen | 229/191 |
| 2,468,951 | 5/1949 | Barter | 229/178 |
| 3,410,475 | 11/1968 | Wagner | 229/178 |
| 3,973,723 | 8/1976 | Owens | 229/178 |
| 4,129,247 | 12/1978 | McCall | 229/178 |
| 4,770,339 | 9/1988 | Weimer . | |
| 4,884,739 | 12/1989 | Nederveld . | |
| 4,911,355 | 3/1990 | Barnister | 229/919 |
| 5,184,772 | 2/1993 | McGrath | 229/178 |

FOREIGN PATENT DOCUMENTS

| | | | |
|---|---|---|---|
| 1383824 | 11/1964 | France | 229/178 |
| 1409752 | 7/1965 | France | 229/915 |
| 556550 | 2/1957 | Italy | 229/918 |
| 2194776 | 3/1988 | United Kingdom | 229/915 |

*Primary Examiner*—Gary E. Elkins
*Attorney, Agent, or Firm*—Arnold, White & Durkee

[57] ABSTRACT

A ventilated container for storing fresh produce is formed from a unitary continuous blank. The ventilated container includes a bottom wall, first and second opposing side walls, and first and second opposing end walls. The first and second side walls and the first and second end walls intersect with one another to form four inside corners of the container. The container forms a plurality of vents to permit air to flow through the container. Each of the first and second end walls is formed from an inner panel and an outer panel hingedly connected to each other along a substantially rigid upper ledge. The container includes four polygonal corner posts disposed adjacent the respective four inside corners of the container and extending from the bottom wall to a height of the upper ends of the respective corners. To enhance the stacking strength of the container, first and second minor flaps extend from opposing ends of the first side wall and third and fourth minor flaps extend from opposing ends of the second side wall. Each of the first, second, third, and fourth minor flaps includes a pair of overlapping panels hingedly connected to each other. The first and third minor flaps are captured between the inner and outer panels of the first end wall, and the second and fourth minor flaps are captured between the inner and outer panels of the second end wall.

13 Claims, 4 Drawing Sheets

STACKABLE CONTAINER FOR STORING FRESH PRODUCE

FIELD OF THE INVENTION

The present invention relates generally to stackable containers for storing fresh produce during cooling and shipment. More particularly, the present invention relates to a stackable ventilated container which provides superior stacking strength.

BACKGROUND OF THE INVENTION

On ranches for harvesting fresh produce such as grapes, exotics, lightweight tree fruit, and other fruits and vegetables, the harvested produce is often placed in a ventilated box or container. In some applications, the fresh produce is initially packed into a plurality of smaller ventilated plastic containers or bags which, in turn, are loaded into the ventilated box or container. The ventilated container typically includes a bottom wall, a pair of opposing side walls, and a pair of opposing end walls. After packing the harvested produce into the ventilated container, the container is loaded onto a pallet. The foregoing process of packing the harvested produce into a ventilated container and loading the ventilated container onto the pallet is repeated until the pallet supports a predetermined number (e.g., 96) of the ventilated containers. The ventilated containers are typically arranged on the pallet in multiple stacks. For example, if the pallet is a North American Grocery Industry standard pallet measuring 40 inches in width by 48 inches in length and the ventilated container measures approximately 20 inches in width by 12 inches in length, the pallet can support 96 ventilated containers arranged in eight stacks with twelve containers per stack.

After the predetermined number of ventilated containers are loaded onto the pallet, the loaded pallet is moved to a refrigeration unit to cool and/or store the fresh produce. Since the refrigeration unit has a limited capacity, it is important that the ventilated containers be designed for optimal cooling efficiency. To optimize cooling efficiency, the ventilated containers are provided with strategically positioned cooling vents. Cool air from the refrigeration unit flows or is forced through the vents in the containers. After cooling the fresh produce in the ventilated containers, the ventilated containers are shipped to grocery stores and fresh produce markets, where the fresh produce is sold to consumers.

During cooling, shipping and storage of the ventilated containers, it is important to prevent compression and breakdown of the side walls and end walls of the ventilated containers while they are stacked on top of one another. To exhibit superior stacking performance, the ventilated containers should provide sufficient torsional and flexural (structural) rigidity. Without structural rigidity, containers at or near the bottom of a stack could buckle under the weight of the containers stacked above them. Due to this buckling, the fresh produce in one or more containers may either be damaged or destroyed. Furthermore, without appropriate structural characteristics, the containers could sway or amplify vibration in transit, thereby causing abrasion damage to the fresh produce.

Accordingly, a need exists for a stackable ventilated container which provides sufficient structural rigidity and, therefore, exhibits enhanced stacking strength.

SUMMARY OF THE INVENTION

In one particular embodiment of the present invention, the ventilated container for storing fresh produce is formed from a unitary continuous blank. The ventilated container includes a bottom wall, first and second opposing side walls, and first and second opposing end walls. The first and second side walls and the first and second end walls intersect with one another to form four inside corners of the container. The container forms a plurality of vents to permit air to flow through the container. To enhance the structural rigidity of the container, each of the first and second end walls is formed from an inner panel and an outer panel hingedly connected to each other along a substantially rigid upper ledge. Furthermore, the container includes four polygonal corner posts disposed adjacent the respective four inside corners of the container and extending from the bottom wall to a height of the upper ends of the respective corners.

An important feature of the present invention which further enhances the stacking strength of the container is the construction of minor flaps extending from opposing ends of each side wall. More specifically, first and second minor flaps extend from opposing ends of the first side wall and third and fourth minor flaps extend from opposing ends of the second side wall. Each of the first, second, third, and fourth minor flaps includes a pair of overlapping panels hingedly connected to each other. The first and third minor flaps are captured between the inner and outer panels of the first end wall, and the second and fourth minor flaps are captured between the inner and outer panels of the second end wall. Since each flap includes a pair of overlapping panels, capturing each minor flap between the inner and outer panels of the respective end wall significantly improves the rigidity of the end walls, thereby improving the stacking strength of the container.

BRIEF DESCRIPTION OF THE DRAWINGS

Other objects and advantages of the invention will become apparent upon reading the following detailed description and upon reference to the drawings in which.

Figure 2:
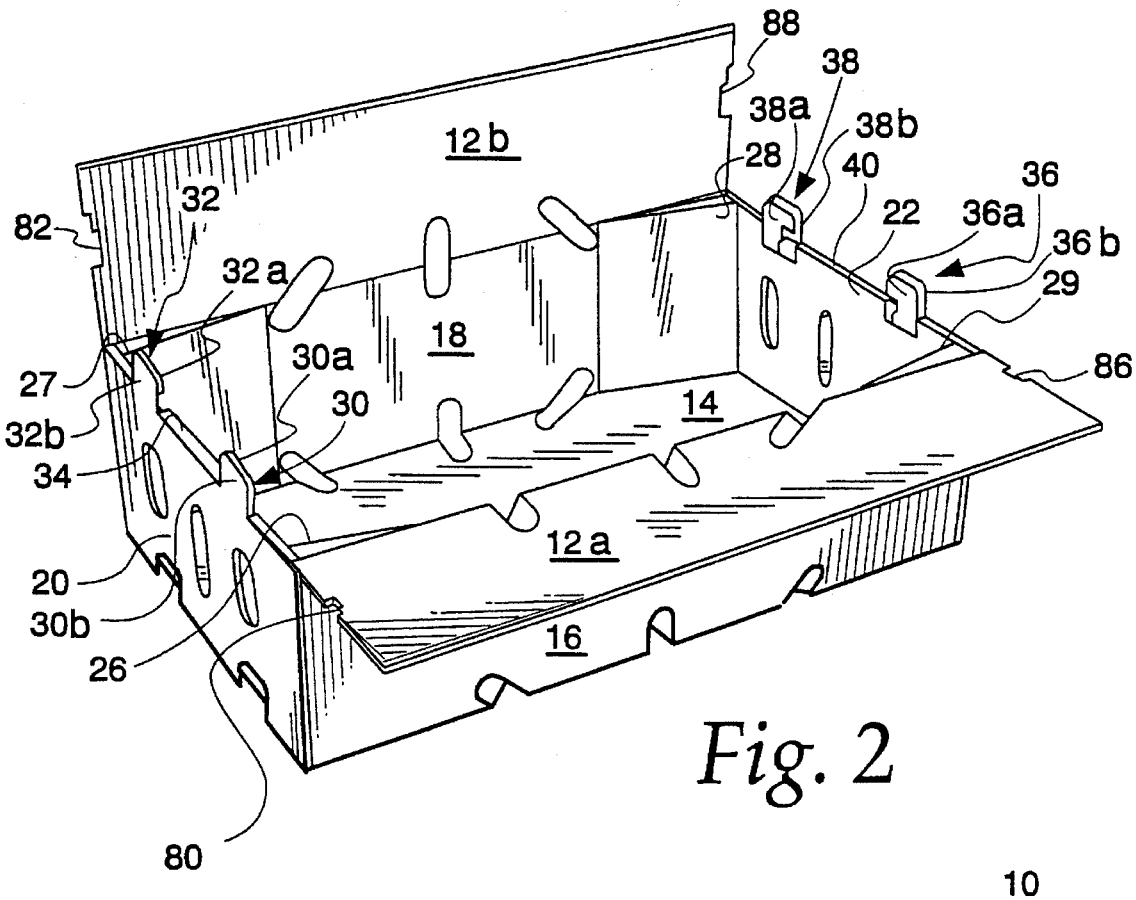
FIG. 2 is a perspective view of the ventilated container in FIG. 1, showing both of the top wall flaps of the container in an open condition.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 1:
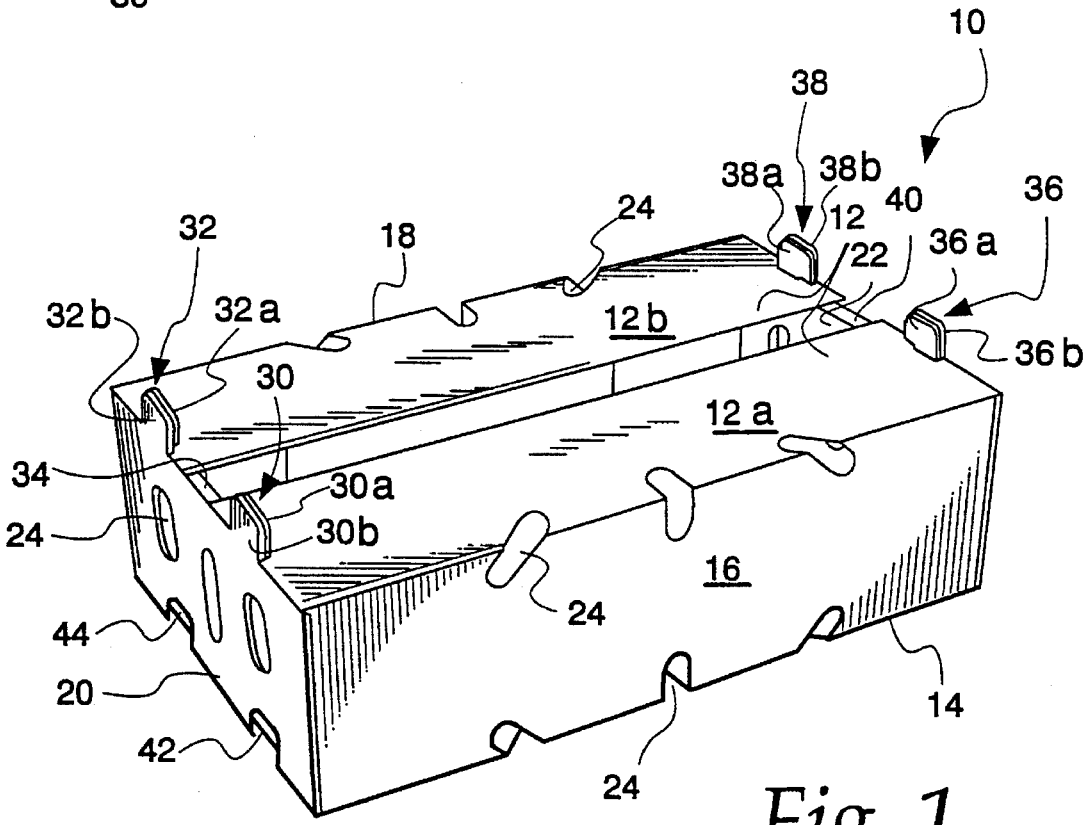
FIG. 1 is a perspective view of a stackable ventilated container embodying the present invention, showing top wall flaps of the container in a closed condition.

Turning now to the drawings, FIGS. 1 and 2 illustrate a stackable ventilated container 10 composed of a relatively rigid material such as corrugated board, solid fiber board, heavy paperboard, or heavy plastic sheet. FIG. 1 depicts the container 10 in its closed form, while FIG. 2 depicts the container 10 in its opened form. The ventilated container 10 includes opposing top and bottom walls 12, 14, a pair of opposing side walls 16, 18, and a pair of opposing end walls 20, 22. The top wall 12 is formed from a pair of major top flaps 12*a*, 12*b* hingedly connected to the respective side walls 16, 18. To circulate cool air through the container 10 during refrigeration, the walls of the container 10 form a plurality of vents 24. The vents 24 are strategically positioned to optimize the flow of cool air through the container 10, thereby maximizing cooling efficiency.

To enhance the stacking strength of the container 10, the container 10 includes four triangular corner posts 26, 27, 28, and 29 disposed adjacent respective inside corners of the container 10, where the corners are defined by the intersection of the side walls 16, 18 and the end walls 20, 22. In particular, the corner post 26 is situated adjacent the corner defined by the intersection of the side wall 16 and the end wall 20; the corner post 27 is situated adjacent the corner defined by the intersection of the side wall 18 and the end wall 20; the corner post 28 is situated adjacent the corner defined by the intersection of the side wall 18 and the end wall 22; and the corner post 29 is situated adjacent the corner defined by the intersection of the side wall 16 and the end wall 22.

The corner posts 26–29 are generally perpendicular to the bottom wall 14. Moreover, when the container 10 is in its closed form (FIG. 1), the corner posts 26– 29 extend upwardly from the bottom wall 14 to the top wall 12 of the container 10. In the preferred embodiment, each of the corner posts 26–29 has a triangular cross-section where the cross-section is taken along an imaginary plane parallel to the bottom wall 14. The triangular corner posts 26–29 significantly enhance the stacking strength of the container 10 and, at the same time, minimize the amount of material necessary to produce the corner posts 26. If desired, however, each of the corner posts 26–29 may be designed with a cross-section having a rectangular or other polygonal shape.

To permit stacking of several identical ventilated containers 10 in a reliable, stable, and balanced manner, the container 10 is provided with a plurality of stacking tabs and a plurality of stacking slots. In a preferred embodiment, a pair of stacking tabs 30, 32 extend upwardly from an upper transverse ledge 34 of the end wall 20, and a pair of stacking tabs 36, 38 extend upwardly from an upper transverse ledge 40 of the end wall 22. When an identical container is stacked on top of the closed is container 10 in FIG. 1, the stacking tabs 30, 32 are received by slots akin to slots 42, 44 of the container 10, and the stacking tabs 36, 38 are received by slots akin to slots 46, 48 (FIGS. 3 and 4).

Figure 3:
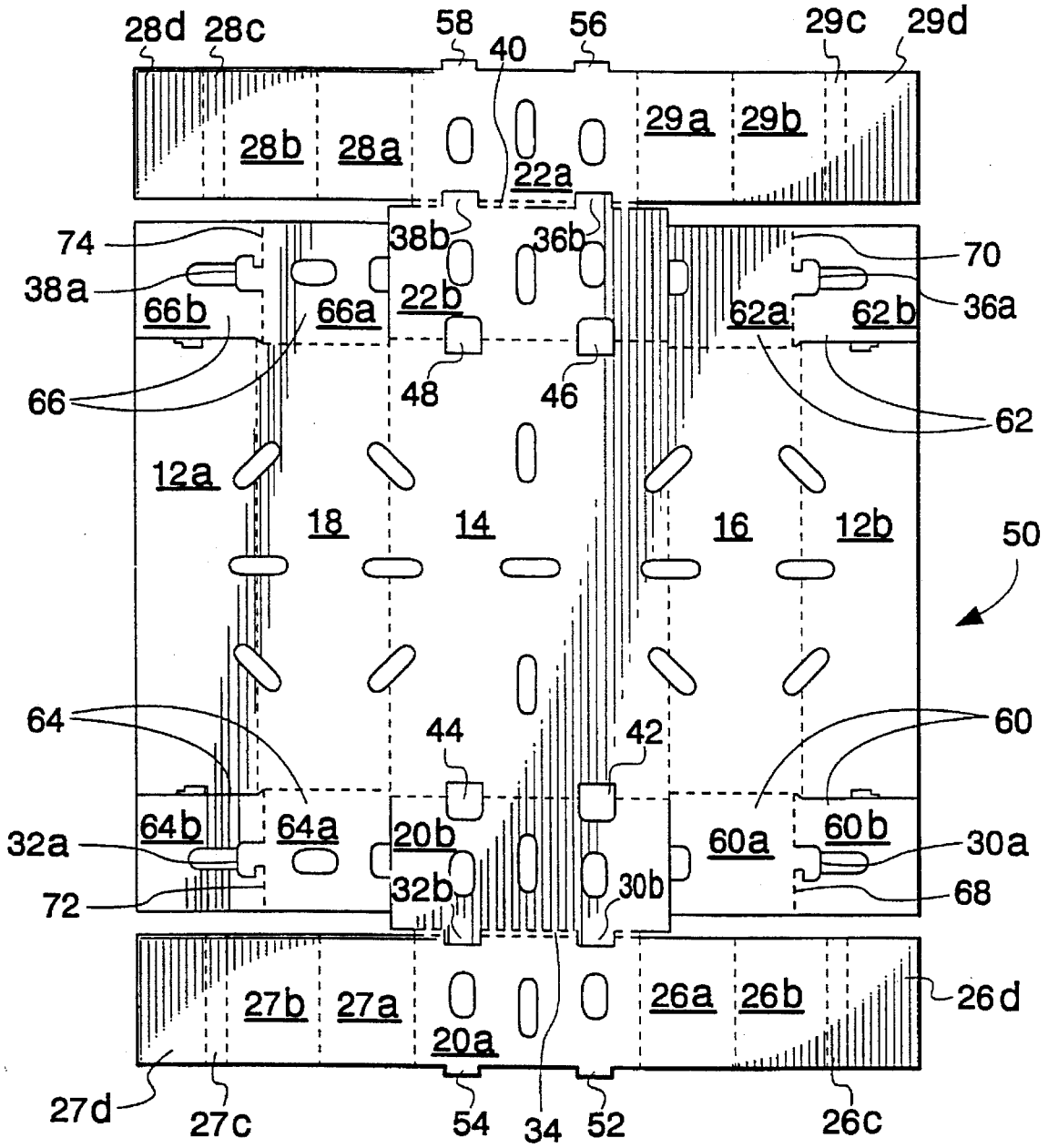
FIG. 3 is a plan view of the inner surface of a blank for forming the ventilated container in FIG. 1.
Figure 4:
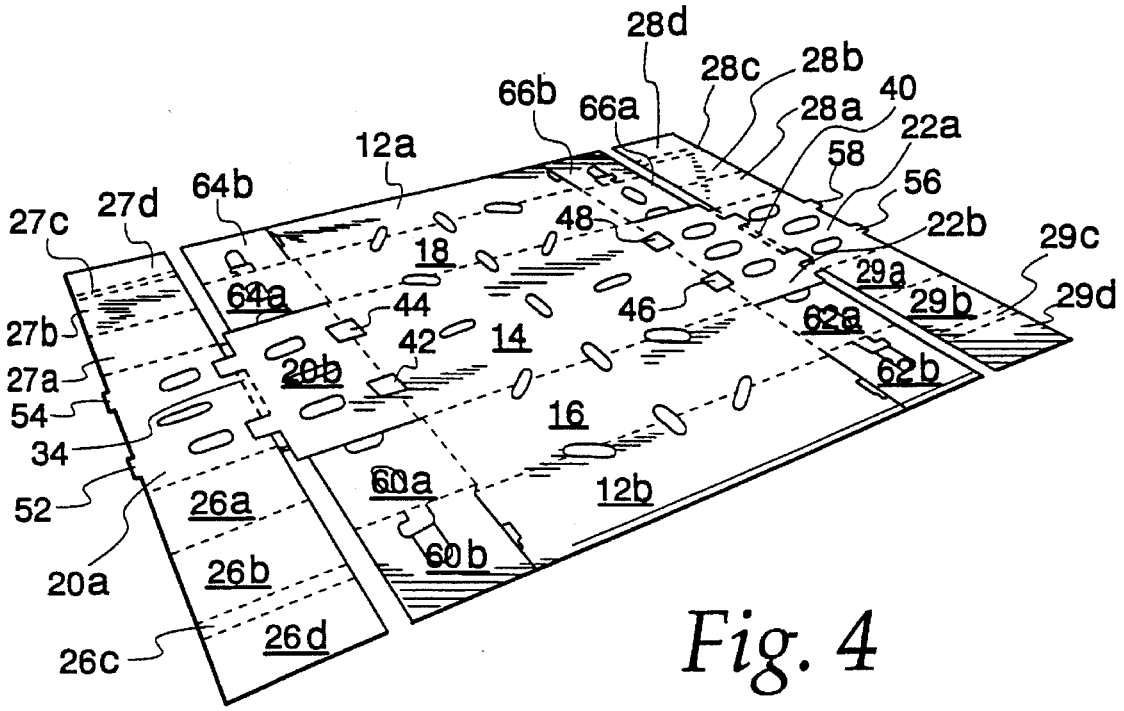
FIGS. 4 through 7 are perspective views illustrating the sequence in which the panels of the blank in FIG. 3 are folded to form the ventilated container in FIGS. 1 and 2.

The ventilated container 10 is formed from a blank 50 depicted in FIG. 3. FIG. 3 is a plan view of the inner surface of the blank 50, while FIGS. 4 through 7 are perspective views illustrating the sequence in which the panels of the blank 50 in FIG. 3 are folded to form the ventilated container 10. The container blank 50 is in the form of a planar, unitary section of rigid material such as corrugated board, solid fiber board, heavy paperboard, or heavy plastic sheet. The panels of the blank 50 are hingedly connected to each other by conventional creases and score lines to facilitate folding of the panels relative to one another. With respect to the assembled container 10 in FIGS. 1 and 2, corresponding parts are indicated by the same reference numerals.

Referring to FIG. 3, the blank 50 reveals that the end walls 20, 22 are each formed from generally parallel inner and outer panels hingedly connected to each other along a rigid upper ledge. In particular, the end wall 20 is formed from inner and outer panels 20*a*, 20*b* hingedly connected to each other along the rigid upper ledge 34. The outer panel 20*b* is hingedly connected to the bottom wall 14, and the inner panel 20*a* is detachably connected to the bottom wall 12 by means of locking tabs 52, 54 which interlock with the respective locking slots 42, 44 in the bottom wall 14. Similarly, the end wall 22 is formed from inner and outer panels 22*a*, 22*b* hingedly connected to each other along the rigid upper ledge 40. The outer panel 22*b* is hingedly connected to the bottom wall 14, and the inner panel 22*a* is detachably connected to the bottom wall 14 by means of locking tabs 56, 58 which interlock with the respective locking slots 46, 48 in the bottom wall 14.

The blank 50 further reveals that a first pair of minor flaps 60, 62 extend from opposing ends of the side wall 16 and a second pair of minor flaps 64, 66 extend from opposing ends of the side wall 18. Each of the minor flaps 60, 62, 64, and 66 includes a pair of panels hingedly connected to each other. In particular, the minor flap 60 includes the pair of panels 60*a*, 60*b* hingedly connected to each other along a crease 68; the minor flap 62 includes the pair of panels 62*a*, 62*b* hingedly connected to each other along a crease 70; the minor flap 64 includes the pair of panels 64*a*, 64*b* hingedly connected to each other along a crease 72; and the minor flap 66 includes the pair of panels 66*a*, 66*b* hingedly connected to each other along a crease 74. As explained below, when the blank 50 is folded to form the ventilated container 10 in FIGS. 1 and 2, the pair of panels associated with each minor flap are folded about their adjoining crease so that the panels overlap one another (see FIGS. 5 and 6). The overlapping panels of each minor flap are then entrapped between the inner and outer panels of the most proximate end wall. Such entrapment of the overlapping panels of each minor flap significantly enhances the structural rigidity of the end walls of the container 10, thereby improving the stacking strength of the container 10.

The blank 50 also reveals that the corner posts 26, 27, 28, and 29 are each formed from four panels hingedly connected to each other along parallel score lines. In particular, the corner post 26 is formed from the four panels 26*a*–*d*, the corner post 27 is formed from the four panels 27*a*–*d*, the corner post 28 is formed from the four panels 28*a*–*d*, and the corner post 29 is formed from the four panels 29*a*–*d*. As explained below, the four panels of each corner post are successively folded about their adjoining score lines to provide the corner post with the triangular shape illustrated in FIG. 2.

Figure 5:
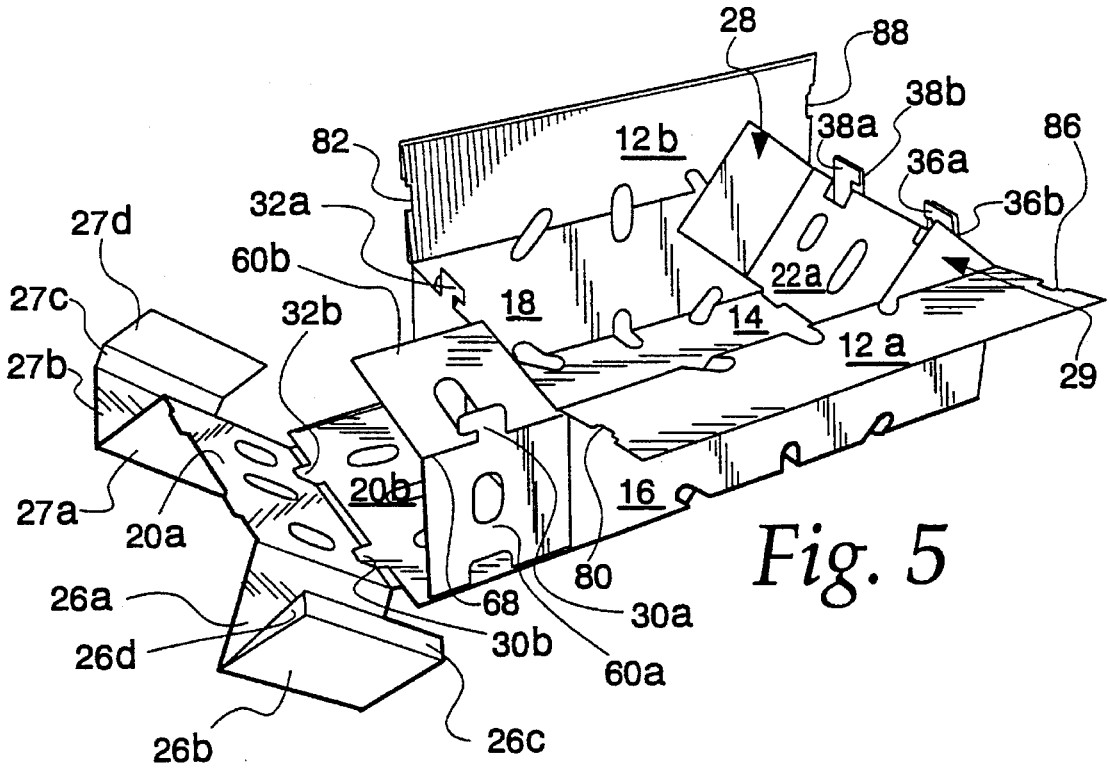
Figure 6:
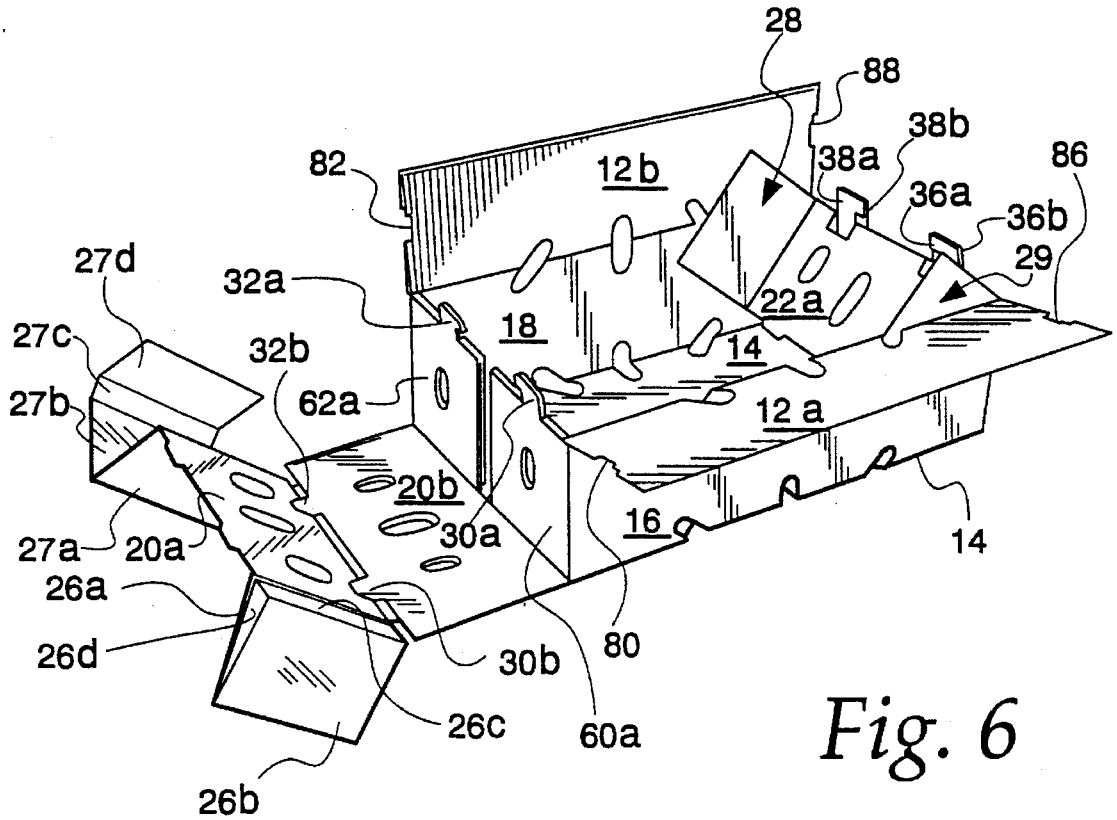

Referring to FIGS. 4–7, the container 10 may be formed from the blank 50 by hand or machine using the sequence of folding steps detailed below. First, the side walls 16, 18 are each rotated upward approximately 90 degrees relative to the bottom wall 14 (FIG. 5). Second, the pair of panels associated with each minor flap are folded about their adjoining crease so that they overlap each other. Thus, the panels 60*b*, 62*b*, 64*b*, and 66*b* are rotated inward approximately 180 degrees about the respective creases 68, 70, 72, and 74 so that the inner surfaces of these panels face the inner surfaces of the respective minor flap panels 60*a*, 62*a*, 64*a*, and 66*a*. FIG. 5 illustrates the minor flap panel 60*b* in the process of being folded about the crease 68. Third, the panels 60*a*, 62*a* of the respective minor flaps 60, 62 are each rotated inward approximately 90 degrees relative to the side wall 16 (FIG. 6). Likewise, the panels 64*a*, 66*a* of the minor flaps 64, 66 are each rotated inward approximately 90 degrees relative to the side wall 18.

Fourth, to form the corner posts 26–29, the panels 26*a*, 27*a* are each rotated downward approximately 90 degrees relative to the inner end wall panel 20*a* (FIGS. 5 and 6), and the panels 28*a*, 29*a* are each rotated downward approximately 90 degrees relative to the inner end wall panel 22*a*. The four panels associated with each corner post are then successively folded, as best illustrated in FIGS. 5 and 6 for the corner posts 26, 27, to create the triangular configuration depicted in FIG. 2. To form the corner post 26, for example, the panel 26*d* is rotated approximately 180 degrees relative to the panel 26*b* with the narrow panel 26*c* serving as a double crease. Such rotation of the panel 26*d* causes the inner surface of the panel 26*d* to face the inner surface of the panel 26*b*. During or after rotation of the panel 26*d* relative to the panel 26*b*, the panel 26*b* is rotated slightly less than 180 degrees relative to the panel 26*a* so that the outer surface of the panel 26*d* abuts the inner surface of the panel 26*a* (FIG. 6). The remaining corner posts 27, 28, and 29 are formed in similar fashion. Therefore, in the formed corner posts 27, 28, and 29, the outer surfaces of the panels 27*d*, 28*d*, and 29*d* abut the inner surfaces of the respective panels 27*a*, 28*a*, and 29*a*.

Figure 7:
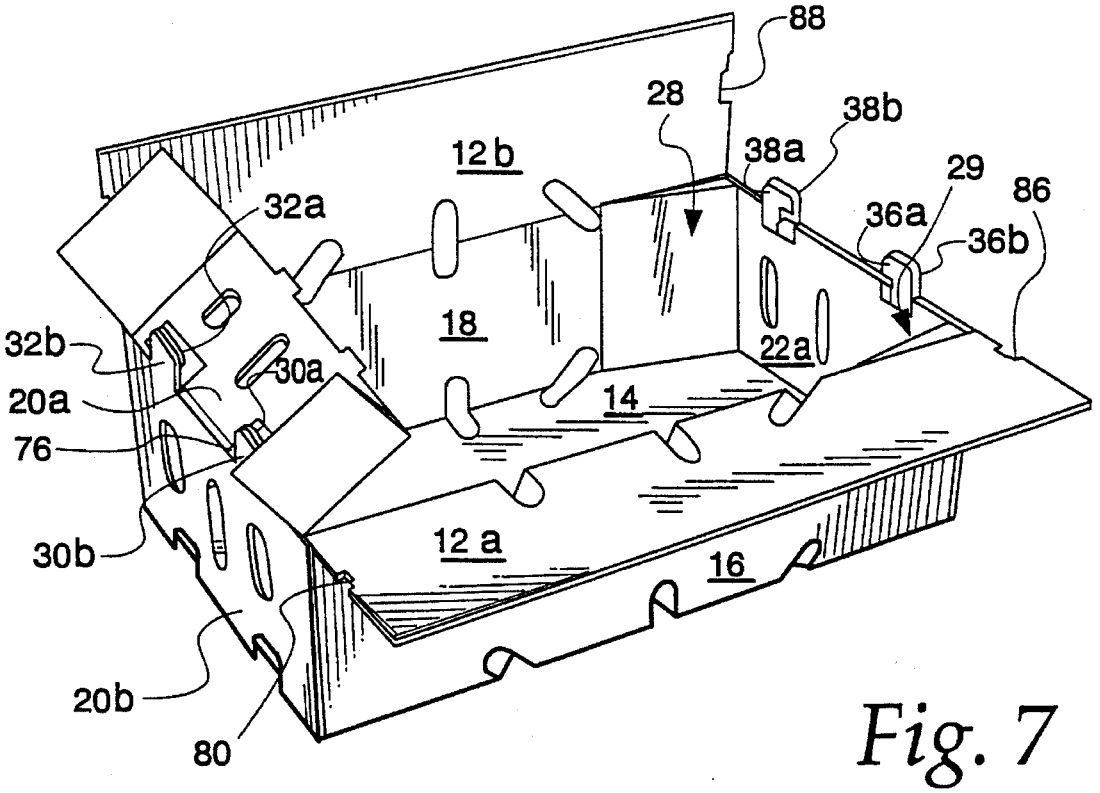

Fifth, to commence formation of the end walls 20, 22, the outer end wall panels 20*b*, 22*b* are each rotated upward approximately 90 degrees relative to the bottom wall 14. FIG. 7 illustrates the outer end wall panel 20*b* after it has been rotated upward 90 degrees relative to the bottom wall 14. Sixth, either during or after rotation of the outer end wall panels 20*b*, 22*b* relative to the bottom wall 14, the inner end wall panels 20*a*, 22*a* are rotated inward approximately 180 degrees relative to the respective outer end wall panels 20*b*, 22*b*. During this rotation of the inner end wall panels 20*a*, 22*a*, the narrow panels/ledges 34, 40 provide double creases to facilitate relative movement between the inner panels 20*a*, 22*a* and the respective outer panels 20*b*, 22*b*. FIGS. 5 and 6 depicts the inner end wall panel 22*a* in the process of being rotated inward relative to the outer end wall panel 22*b*, while FIG. 7 depicts the inner end wall panel 20*a* in the process of being rotated inward relative to the outer end wall panel 20*b*.

To lock the inner panel 20*a* in place, the locking tabs 52, 54 are secured in the respective locking slots 42, 44. In this position, the corner posts 26, 27 are adjacent the inside corners formed by the side walls 16, 18 and the end wall 20, and the minor flaps 60, 64 are trapped between the inner and outer end wall panels 20*a*, is 20*b*. Similarly, to lock the inner panel 22*a* in place, the locking tabs 56, 58 are secured in the respective locking slots 46, 48. In this position, the corner posts 28, 29 are adjacent the inside corners formed by the side walls 18, 16 and the end wall 22, and the minor flaps 62, 66 are trapped between the inner and outer end wall panels 22*a*, 22*b*.

In an alternative folding sequence, the corner posts 26–29 are primarily formed after forming the end walls 20, 22. Prior to forming the end walls 20, 22, the only folding step associated with the corner posts 26–29 is to rotate the post panels 26*a*, 27*a* downward approximately 90 degrees relative to the inner end wall panel 20*a* and to rotate the post panels 28*a*, 29*a* downward approximately 90 degrees relative to the inner end wall panel 22*a*. Such folding of the post panels 26*a*, 27*a*, 28*a*, and 29*a* is necessary in order to prevent the four panels associated with each corner post from obstructing the formation of the end walls 20, 22. After forming the end walls 20, 22, the four panels associated with each corner post are folded relative each other to create the triangular configuration depicted in FIG. 2.

The construction of the corner posts 26–29 lends itself to the use of the alternative folding sequence described above. Referring to FIG. 3, each corner post is formed from three outer panels and one inner tuck panel; for example, the corner post 26 is formed from the three outer panels 26*a–c* and the inner tuck panel 26*d*. The triangular shape of the corner post 26 is maintained by "tucking" the inner tuck panel 26*d* between the outer panels 26*a*, 26*b* (see FIGS. 5 and 6). Corner posts constructed with such tuck panels may be formed before or after forming the end walls 20, 22. In contrast, in prior art containers, such as the stackable grape box disclosed in U.S. Pat. No. 4,770,339 to Weimer, the corner posts do not include such tuck panels. As best shown in FIG. 2 of the Weimer patent, the corner posts disclosed therein each include only three panels labelled by the reference numerals (62), (64), and (66). The third panel (66) forms the short side of the corner post, as well as a portion of the end wall. With such a construction, the corner post in the Weimer patent must be formed prior to forming the end walls.

A particularly advantageous feature of the present invention is the entrapment of the double-paneled minor flaps 60, 64 between the inner and outer end wall panels 20*a*, 20*b* and the entrapment of the double-paneled minor flaps 62, 66 between the inner and outer end wall panels 22*a*, 22*b*. In prior art containers, such as the stackable grape box disclosed in U.S. Pat. No. 4,770,339 to Weimer, only single-paneled minor flaps are captured between the inner and outer end wall panels. As best shown in FIG. 2 of the Weimer patent, the minor flaps labelled by the reference numeral (30) each consist of only a single panel. A drawback of such single-paneled minor flaps is that they fail to adequately reinforce the end walls of the box.

In contrast, when the minor flaps 60, 62, 64, and 66 of the present invention are captured between their associated end wall panels, the pair of panels associated with each minor flap substantially overlap and abut one another. In particular, the panel 60*a* of minor flap 60 overlaps the panel 60*b*; the panel 62*a* of minor flap 62 overlaps the panel 62*b*; the panel 64*a* of minor flap 64 overlaps the panel 64*b*; and the panel 66*a* of minor flap 66 overlaps the panel 66*b*. FIG. 6 illustrates such overlapping in connection with the minor flaps 60, 64. Due to these overlapping minor flap panels, each end wall is formed from four layers/thicknesses of material. The end wall 20 includes the following four layers: (1) the inner end wall panel 20*a*, (2) the coplanar minor flap panels 60*b*, 64*b* in side-by-side relationship, 3) the coplanar minor flap panels 60*a*, 64*a* in side-by-side relationship, and (4) the outer end wall 20*b*. The end wall 22 includes the following four layers: (1) the inner end wall panel 22*a*, (2) the coplanar minor flap panels 62*b*, 66*b* in side-by-side relationship, 3) the coplanar minor flap panels 62*a*, 66*a* in side-by-side relationship, and (4) the outer end wall 22*b*. The four layers of each end wall significantly enhance the structural rigidity of the end walls 20, 22 of the container 10, thereby improving the stacking strength of the container 10.

If the container 10 is formed from corrugated board, the corrugations improve the structural rigidity of the end walls 20, 22. In the formed container 10 in FIGS. 1 and 2, the corrugations of the entrapped minor flaps 60, 62, 64, and 66 extend in the horizontal direction, while the corrugations of the end wall panels 20*a*, 20*b*, 22*a*, and 22*b* extend in the vertical direction. Therefore, in each end wall, the corrugations of two layers of corrugated board are perpendicular to the corrugations of the other two layers of corrugated board. This combination of horizontal and vertical corrugations in each end wall strengthens the end walls 20, 22, thereby adding structural rigidity and top load compression strength to the container 10.

Each of the stacking tabs 30, 32, 36, and 38 includes a pair of aligned members. More specifically, the stacking tab 30 includes an inner hook-shaped member 30*a* and an outer member 30*b;* the stacking tab 32 includes an inner hook-shaped member 32*a* and an outer member 32*b;* the stacking tab 36 includes an inner hook-shaped member 36*a* and an outer member 36*b;* and the stacking tab 38 includes an inner hook-shaped member 38*a* and an outer member 38*b*. The configurations of the inner and outer members of each stacking tab are best illustrated in FIG. 3.

The inner hook-shaped members 30*a*, 32*a*, 36*a*, and 38*a* of the stacking tabs are formed from the respective minor flaps 60, 64, 62, and 66. For example, the hook-shaped member 30*a* is integrally formed with the minor flap panel 60*a* and is separated from the minor flap panel 60*b* by means of die-cuts. Thus, when the minor flap panel 60*b* in FIG. 5 is folded inward about the crease 68, the inner hook-shaped member 30*a* maintains its vertical stance, extending upwardly from the minor flap panel 60*a*. When the end wall 20 is formed by capturing the double-paneled minor flaps 60, 64 between the inner and outer end wall panels 20*a*, 20*b*, the upstanding hook-shaped member 30*a* protrudes through an aperture 76 in the ledge 34 formed by folding the inner end wall panel 20*a* relative to the outer end wall panel 20*b* (FIG. 7). The other hook-shaped members 32*a*, 36*a*, and 38*a* yield inner portions of the stacking tabs in similar fashion.

The outer members 30*b*, 32*b*, 36*b*, and 38*b* of the stacking tabs are formed in conventional fashion during assembly of the blank 50. The outer members 30*b*, 32*b* are integrally formed with the outer end wall panel 20*b* and are separated from the inner end wall panel 20*a* by means of die-cuts. When the end wall 20 is formed by folding the inner end wall panel 20*a* relative to the outer end wall panel 20*b* in FIG. 7, the outer members 30*b*, 32*b* extend upwardly from the ledge 34 by virtue of their integral link to the outer end wall panel 20*b*. Similarly, the outer members 36*b*, 38*b* are integrally formed with the outer end wall panel 22*b* and are separated from the inner end wall panel 22*a* by means of die-cuts. When the end wall 22 is formed by folding the inner end wall panel 22*a* relative to the outer end wall panel 22*b* in FIG. 6, the outer members 36*b*, 38*b* extend upwardly from the ledge 40 by virtue of their integral link to the outer end wall panel 22*b* (FIGS. 5–7).

In the formed container 10 in FIGS. 1 and 2, the inner hook-shaped members 30*a*, 32*a*, 36*a*, and 38*a* serve two functions. First, these hook-shaped members strengthen the stacking tabs by providing them with a second layer of material. Second, the hook-shaped members lock the top flaps 12*a*, 12*b* in FIG. 1 in the closed position. As best shown in FIG. 2, the top flap 12*a* is provided with a pair of opposing notches 80, 86, and the top flap 12*b* is provided with a pair of opposing notches 82, 88. The notches 80, 86 cooperate with the respective hook-shaped members 30*a*, 36*a* to lock the top flap 12*a* in the closed position (FIG. 1). Likewise, the notches 82, 88 cooperate with the respective hook-shaped members 32*a*, 38*a* to lock the top flap 12*b* in the closed position (FIG. 1). Hook-shaped members of the type described herein are described and illustrated in U.S. Pat. No. 4,884,739 to Nederveld, which is incorporated herein by reference.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A ventilated container for storing fresh produce, comprising:

a bottom wall, first and second opposing side walls, and first and second opposing end walls, said side walls and said end walls intersecting with one another to form four inside corners of the container, said bottom wall, said side walls, and said end walls forming a plurality of vents to permit air to flow through the container, each of said first and second end walls being formed from an inner panel and an outer panel hingedly connected to each other along a substantially rigid upper ledge;

four polygonal corner posts disposed adjacent said respective four inside corners of the container and extending from said bottom wall to a height of upper ends of said respective four inside corners; and first and second minor flaps extending from opposing ends of said first side wall, and third and fourth minor flaps extending from opposing ends of said second side wall, each of said first, second, third, and fourth minor flaps including a pair of overlapping panels hingedly connected to each other, said first and third minor flaps being captured between said inner and outer panels of said first end wall, said second and fourth minor flaps being captured between said inner and outer panels of said second end wall.

2. The ventilated container of claim 1, wherein said pair of overlapping panels of each of said minor flaps are hingedly connected along an upper fold line.

3. The ventilated container of claim 1, wherein the container is formed from a unitary, continuous blank.

4. The ventilated container of claim 3, wherein the container is formed from corrugated board, said inner and outer panels of each of said end walls containing corrugations perpendicular to corrugations of said pair of overlapping panels of each of said minor flaps.

5. The ventilated container of claim 1, wherein each of said polygonal corner posts has a triangular shape.

6. The ventilated container of claim 1, wherein each of said polygonal corner posts is formed from a plurality of outer post panels and at least one inner tuck panel, said inner tuck panel being disposed between two or more of said outer post panels such that said inner tuck panel is substantially concealed by said plurality of outer post panels.

7. The ventilated container of claim 1, wherein said pair of overlapping panels substantially overlap each other.

8. A ventilated container formed from a unitary, continuous blank, comprising:

a bottom wall, first and second opposing side walls, and first and second opposing end walls, said side walls and said end walls intersecting with one another to form four inside corners of the container, said bottom wall, said side walls, and said end walls forming a plurality of vents to permit air to flow through the container, each of said first and second end walls being formed from an inner panel and an outer panel hingedly connected to each other along a substantially rigid upper ledge;

four polygonal corner posts disposed adjacent said respective four inside corners of the container and extending from said bottom wall to a height of upper ends of said respective four inside corners, said corner posts having a polygonal cross-section wherein the polygonal cross-section is taken in an imaginary plane parallel to said bottom wall; and first and second minor flaps extending from opposing ends of said first side wall, and third and fourth minor flaps extending from opposing ends of said second side wall, each of said first, second, third, and fourth minor flaps including a pair of overlapping panels hingedly connected to each other along an upper fold line, said first and third minor flaps being captured between said inner and outer panels of said first end wall, said second and fourth minor flaps being captured between said inner and outer panels of said second end wall.

9. The ventilated container of claim 8, wherein the container is formed from corrugated board, said inner and outer panels of each of said end walls containing corrugations perpendicular to corrugations of said pair of overlapping panels of each of said minor flaps.

10. The ventilated container of claim 8, wherein each of said polygonal corner posts has a triangular shape.

11. The ventilated container of claim 10, wherein each of said triangular corner posts is formed from three outer post panels and at least one inner tuck panel, said inner tuck panel being disposed between two or more of said outer post panels such that said inner tuck panel is substantially concealed by said outer post panels.

12. The ventilated container of claim 8, wherein said pair of overlapping panels substantially overlap each other.

13. A unitary, continuous blank for forming a ventilated container, the blank forming a plurality of apertures which create vents in the ventilated container, the blank comprising:

a central rectangular panel having a first pair of opposing edges and a second pair of opposing edges;

a first outer end wall panel hingedly connected to one of said first pair of opposing edges, a second outer end wall panel hingedly connected to the other of said first pair of opposing edges, a first inner end wall panel hingedly connected to said first outer end wall panel along a first pair of parallel score lines forming a first ledge panel therebetween, a second inner end wall panel hingedly connected to said second outer end wall panel along a second pair of parallel score lines forming a second ledge panel therebetween, first and second sets of corner post-forming panels extending from opposing ends of said first inner end wall panel, third and fourth corner post-forming panels extending from opposing ends of said second inner end wall panel;

a first side wall panel hingedly connected to one of said second pair of opposing edges, and a second side wall panel hingedly connected to the other of said second pair of opposing edges; and first and second minor flaps extending from opposing ends of said first side wall panel, and third and fourth minor flaps extending from opposing ends of said second side wall panel, each of said first, second, third, and fourth minor flaps including a pair of overlappable panels hingedly connected to each other along a crease, said overlappable panels overlapping each other in response to folding said pair of overlappable panels relative to each other about said crease.

* * * * *